United States Patent [19]

Boyhan

[11] Patent Number: 4,766,620

[45] Date of Patent: Aug. 30, 1988

[54] SMALL CHILD'S HAIR WASHING DEVICE

[76] Inventor: Arlene P. Boyhan, 215 Daniels Ave., Bridgeport, Conn. 06606-1513

[21] Appl. No.: 78,584

[22] Filed: Jul. 27, 1987

[51] Int. Cl.[4] ..... A47K 3/12

[52] U.S. Cl. ..... 4/516; 4/519; 4/520

[58] Field of Search ..... 4/515, 523, 572, 520, 4/571, 573, 575, 659, 517, 521, 519, 516; 297/182

[56] References Cited

U.S. PATENT DOCUMENTS

| | | | |
|---|---|---|---|
| 906,410 | 12/1908 | Greene | 4/520 |
| 2,285,900 | 6/1942 | Chapman | 4/572 |
| 2,463,049 | 3/1949 | Onsa | 4/517 |
| 2,505,252 | 4/1950 | Langley | 4/572 |
| 2,507,848 | 5/1950 | Bashaw | 4/575 |
| 2,527,868 | 10/1950 | Wilson | 4/523 |
| 2,647,561 | 8/1953 | Szabo | 4/572 |
| 2,697,480 | 12/1954 | DuBois et al. | 4/572 |
| 2,825,911 | 3/1958 | Townsley | 4/659 |
| 2,876,459 | 3/1959 | Ackerson | 4/659 |
| 3,505,691 | 4/1970 | Reynolds et al. | 4/517 |
| 3,545,012 | 12/1970 | Espin | 4/523 |
| 3,545,016 | 12/1970 | Schorken | 4/659 |
| 3,633,222 | 1/1972 | Greenfield | 4/520 |
| 3,855,644 | 12/1974 | Benson | 4/575 |
| 3,965,496 | 6/1976 | Grelle | 4/572 |
| 4,196,478 | 4/1980 | Cowell | 4/515 |
| 4,352,216 | 10/1982 | Grim | 4/523 |

FOREIGN PATENT DOCUMENTS

| | | | |
|---|---|---|---|
| 0156690 | 10/1985 | European Pat. Off. | 4/572 |
| 425998 | 3/1925 | Fed. Rep. of Germany | 4/572 |

*Primary Examiner*—Henry J. Recla
*Attorney, Agent, or Firm*—CTC & Associates

[57] ABSTRACT

A small child's hair washing device includes a body support portion for supporting the child's body in supine position on a counter top adjacent a sink, a head rest portion for supporting the child's head above the sink, a neck support portion adjacent the head rest portion and a drain portion between the body support portion and the neck support portion. The body support portion is releasably engaged with the counter top to hold the device in desired overlapping relationship with the sink and a safety strap may be provided to restrain the child relative to the device during the hair washing operation.

8 Claims, 1 Drawing Sheet

SMALL CHILD'S HAIR WASHING DEVICE

BACKGROUND OF THE INVENTION

This invention relates to a small child's hair washing device, and, more particularly to such a device for use typically by an adult in washing the child's hair.

The device is of simple construction and yet both of the user's hands are available for use in performing the washing function.

More particularly, the device is placed on a counter top overlapping the edge of a sink, and the child is placed in a comfortable supine position on the device with his or her head firmly supported over the sink while his or her hair is washed.

It is well known that small children are subject to neck injuries due to undeveloped neck muscles. The inventive hair washing device supports a small child's head in such a way as to minimize risk of neck injury.

It is an important object of the invention to provide a simple device for use in washing a small child's hair.

It is a further important object of the invention to provide such a device which minimizes the risk of neck injuries due to undeveloped musculature of small children's necks.

Other objects and advantages will appear hereinafter.

The following U.S. Patents were found in a novelty search hereon and are believed to be indicative of the state-of-the-art:

| U.S. Pat. No. | Date | Inventor |
|---|---|---|
| 2,475,259 | July 5, 1949 | Singleton |
| 3,449,771 | June 17, 1969 | Watson |
| 3,579,666 | May 25, 1971 | Guarrasi |
| 3,731,325 | May 8, 1973 | Guarrasi |
| 4,407,028 | October 4, 1983 | Nolan |
| 4,419,774 | December 13, 1983 | Hajek |

These prior patents are believed not to be relevant to the invention claimed herein, since the prior patents do not appear to teach a device which is simply placed in overlapping relationship with the edge of a sink, and they do not seem to address the problem posed by small childrens' undeveloped neck muscles.

SUMMARY OF THE INVENTION

A small child's hair washing device embodying the invention comprises a body support portion for supporting the child's body in supine position on a counter top adjacent a sink, a head rest portion for supporting the child's head above the sink, a neck support portion adjacent the head rest portion and a drain portion between the body support portion and the neck support portion. The body support portion may be provided with means, such as suction cups, for releasably engaging the counter top to hold the device in desired overlapping relationship with the sink and safety strap means may be provided to restrain the child relative to the device during the hair washing operation.

DESCRIPTION OF THE INVENTION

Figure 1:
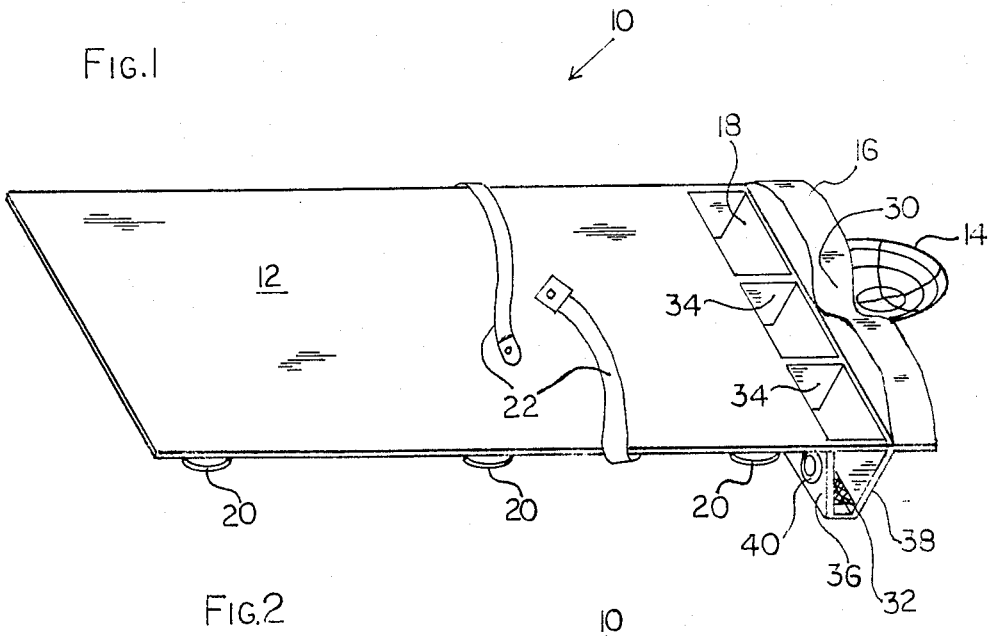
FIG. 1 is a perspective view of a small child's hair washing device that is a preferred embodiment of the invention.

The drawing shows a small child's hair washing device 10 which is a preferred embodiment of the invention. Device 10 comprises a body support portion 12, a head rest portion 14, a neck support portion 16 adjacent head rest portion 14 and a drain portion 18 between body support portion 12 and neck support portion 16.

Body support portion 12 is generally rectangular and flat and is provided on its lower surface with means such as a plurality of suction cups 20 for releasably affixing device 10 to a counter top 24 adjacent a sink 26 with a drain 28, with head rest portion 14, neck support portion 16 and drain portion 18 overlapping the edge of counter top 24 above sink 26. Other examples of the releasable affixing means are double sided adhesive tape, clamps, and mating keys and key slots.

Figure 2:
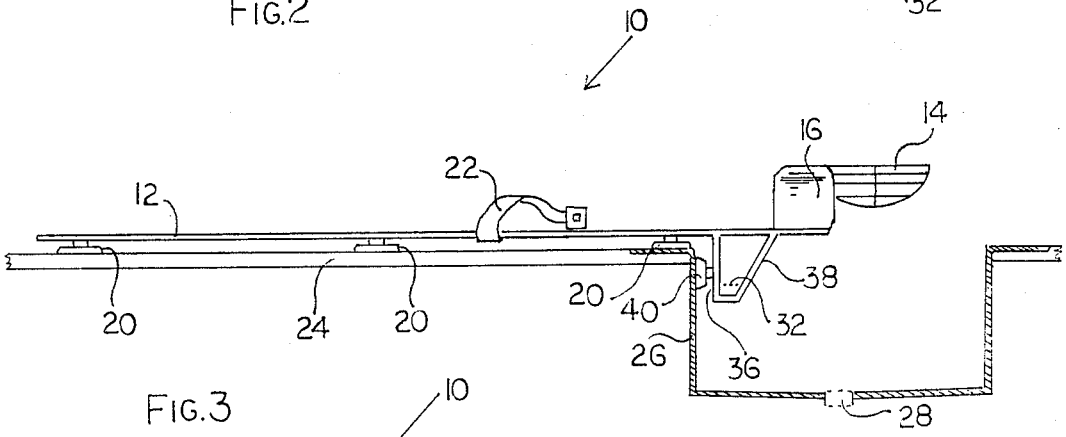
FIG. 2 is a side elevation of the device of FIG. 1 showing the device mounted on a counter top in overlapping relationship with a sink.
Figure 3:
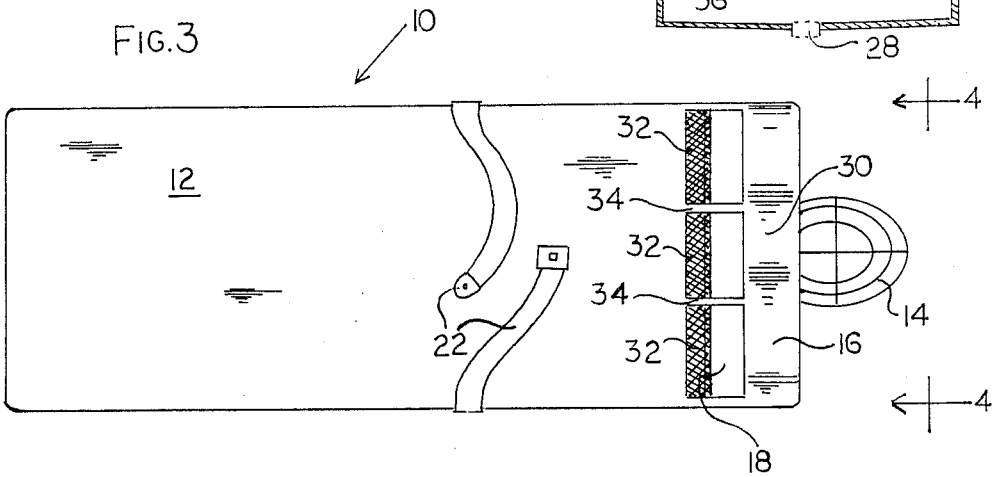
FIG. 3 is plan view of the device of FIGS. 1 and 2.
Figure 4:
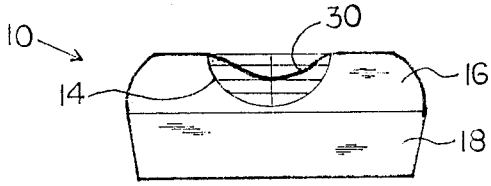
FIG. 4 is a view on line 4—4 of FIG. 3.

With device 10 releasably affixed to counter top 24 as just described and shown in FIG. 2, a small child (not shown) can be placed in supine position with his or her body on body support portion 12, his or her head supported by head rest portion 14 and with his or her neck supported by neck support portion 16.

Body support portion 12 also is provided with safety strap means 22, whereby the child's body can be maintained in fixed position with respect to device 10, thus freeing both hands of an adult for use in washing the child's hair.

Head rest portion 14 is porous to the passage of liquid, being shown in the form of a piece of screen material, while neck support portion 16 is made of soft material with a central concave channel portion 30.

Drain portion 18 is substantially V-shaped and extends below the plane of body support portion 12 and is provided at its bottom with screening 32. Stiffening ribs 34 join the two sides 36 and 38 of the V. Side 36 intersects and is substantially perpendicular to body support portion 12 and may be provided with suction cups 40 for engaging the side of sink 26, further to immobilize device 10 relative to sink 36.

It is apparent that the invention attains the stated objects and advantages and others.

The disclosed details are exemplary only and are not to be taken as limitations on the invention except as those details are included in the appended claims.

What is claimed is:

1. A small child's hair washing device comprising a body support portion for supporting the child's body in supine position on a counter top adjacent a sink, a head rest portion for supporting the child's head above the sink, a neck support portion adjacent the head rest portion and between said head rest portion and said body support portion, and a drain portion between said body support portion and said neck support portion, wherein said drain portion is V-shaped and has stiffening ribs joining the sides of the V, said sides extending crosswise of said device and wherein one of said sides of said V intersects and is substantially perpendicular to said body support portion and is provided with suction cups for engaging the side of the sink.

2. A device according to claim 1 wherein said body support portion is provided with means for releasably affixing said device to the counter top.

3. A device according to claim 2 wherein said releasably affixing means includes a plurality of suction cups.

4. A device according to claim 2 wherein said body support portion is provided with safety strap means to restrain the child relative to said device.

5. A device according to claim 1 wherein said head rest portion is porous to the passage of liquid.

6. A device according to claim 5 wherein said head rest portion a piece of screen material.

7. A device according to claim 1 wherein said neck support portion is made of soft material and has a central concave channel portion.

8. A device according to claim 1 wherein said device has a stop surface depending from an end of said body portion for confronting engagement with the side of the sink to position said device relative to said sink.

* * * * *